US010454217B2

(12) United States Patent
Patel

(10) Patent No.: US 10,454,217 B2
(45) Date of Patent: Oct. 22, 2019

(54) RJ45 PLUG WITH COLLAR FOR BONDING TO A CABLE SHIELD

(71) Applicant: Panduit Corp., Tinley Park, IL (US)

(72) Inventor: Satish I. Patel, Roselle, IL (US)

(73) Assignee: Panduit Corp., Tinley Park, IL (US)

( * ) Notice: Subject to any disclaimer, the term of this patent is extended or adjusted under 35 U.S.C. 154(b) by 0 days.

(21) Appl. No.: 15/747,309

(22) PCT Filed: Aug. 7, 2015

(86) PCT No.: PCT/US2015/044309
§ 371 (c)(1),
(2) Date: Jan. 24, 2018

(87) PCT Pub. No.: WO2017/026996
PCT Pub. Date: Feb. 16, 2017

(65) Prior Publication Data

US 2018/0226753 A1 Aug. 9, 2018

(51) Int. Cl.

| | |
|---|---|
| ***H01R 24/00*** | (2011.01) |
| ***H01R 13/62*** | (2006.01) |
| ***H01R 13/625*** | (2006.01) |
| ***H01R 13/213*** | (2006.01) |
| ***H01R 13/6467*** | (2011.01) |
| ***H01R 13/58*** | (2006.01) |
| ***H01R 13/6463*** | (2011.01) |
| ***H01R 24/64*** | (2011.01) |
| *H01R 4/2404* | (2018.01) |
| *H01R 107/00* | (2006.01) |

(52) U.S. Cl.
CPC ..... *H01R 13/6467* (2013.01); *H01R 13/5812* (2013.01); *H01R 13/6463* (2013.01); *H01R 24/64* (2013.01); *H01R 4/2404* (2013.01); *H01R 2107/00* (2013.01)

(58) Field of Classification Search
CPC .... H01R 24/64; H01R 13/6463; H01R 13/58; H01R 4/24
USPC ..... 439/676, 118, 318
See application file for complete search history.

(56) References Cited

U.S. PATENT DOCUMENTS

| | | | |
|---|---|---|---|
| 5,211,590 | A | 5/1993 | Smith et al. |
| 5,951,330 | A | 9/1999 | Reichard, Jr. et al. |
| 5,961,354 | A | 10/1999 | Hashim |

(Continued)

FOREIGN PATENT DOCUMENTS

| | | | |
|---|---|---|---|
| EP | 0899829 | A2 | 3/1999 |
| EP | 2410620 | A1 | 1/2012 |
| EP | 2897234 | A1 | 7/2015 |

*Primary Examiner* — Abdullah A Riyami
*Assistant Examiner* — Thang H Nguyen
(74) *Attorney, Agent, or Firm* — Christopher S. Clancy; James H. Williams; Christopher K. Marlow

(57) ABSTRACT

A high performance plug has a housing, eight contacts contained within the font of the housing, and a termination block that is symmetric about its axis. In one embodiment, the termination block has contact interfaces configure to electrically engage the plug contacts and arranged such that the contact interfaces which are connected to plug contacts 1-8, become connected to plug contacts 8-1 when the termination block is rotated 180 degrees. In one embodiment, the coupling from the paths for contact 3 to contacts 1, 2, 4, and 5, respectively, is the same as the coupling for contact 6 to contacts 7, 8, 5, and 4, respectively.

5 Claims, 20 Drawing Sheets

(56) References Cited

U.S. PATENT DOCUMENTS

| | | | | |
|---|---|---|---|---|
| 5,975,936 | A | 11/1999 | Lin et al. | |
| 5,989,071 | A | 11/1999 | Larsen et al. | |
| 6,162,082 | A * | 12/2000 | Karsten | H01R 13/523 439/318 |
| 6,464,529 | B1 * | 10/2002 | Jensen | H01R 13/6464 439/405 |
| 6,811,445 | B2 | 11/2004 | Caveney et al. | |
| 7,108,564 | B2 | 9/2006 | Liao | |
| 7,175,468 | B1 * | 2/2007 | Chang | H01R 24/64 439/418 |
| 7,425,159 | B2 * | 9/2008 | Lin | H01R 13/6461 439/676 |
| 7,474,737 | B2 | 1/2009 | Crudele et al. | |
| 7,711,093 | B2 | 5/2010 | Crudele et al. | |
| 7,726,999 | B2 * | 6/2010 | Vanzo | H01R 13/6397 439/318 |
| 7,972,183 | B1 * | 7/2011 | Lin | H01R 24/64 439/676 |
| 8,043,124 | B2 | 10/2011 | Caveney et al. | |
| 8,337,238 | B2 * | 12/2012 | Tobey | H01R 9/035 439/460 |
| 8,702,453 | B2 | 4/2014 | Caveney et al. | |
| 8,858,267 | B2 | 10/2014 | Hashim et al. | |
| 8,858,268 | B2 | 10/2014 | Hashim et al. | |
| 8,894,447 | B2 | 11/2014 | Canning et al. | |
| 9,419,393 | B2 * | 8/2016 | Guitard | H01R 13/6272 |
| 2010/0216331 | A1 * | 8/2010 | Amidon | H01R 4/2404 439/404 |

* cited by examiner

RJ45 PLUG WITH COLLAR FOR BONDING TO A CABLE SHIELD

FIELD OF THE INVENTION

The present invention relates generally to electrical connectors and more specifically to a high performance RJ45 type plugs.

BACKGROUND OF THE INVENTION

TIA and International standards define RJ45 plug performance to be compatible with CAT5E, CAT6, and CAT6A mating connectors. The lower category CAT5E plugs were defined to have a lower electrical performance while allowing for higher performance variation. The higher bandwidth plugs, CAT6 and CAT6A, require higher performance with much smaller performance variation. For backward compatibility, CAT6 and CAT6A plug allowable performance range is specified as a subset of CAT5E plug performance range. Industry is considering even higher bandwidth which is to be backward compatible with CAT5E, CAT6 and CAT6A plugs. It is desired that the plug has a highest performance in a range that is a subset of CAT6 and CAT6A plug performance.

As defined, conductor pair 3-6 is split around conductor pair 4-5. Most plug designs including ones in U.S. Pat. Nos. 6,811,445 and 5,727,962, which are herein incorporated by reference in their entirety, split the 3-6 conductor pair to terminate with contacts 3 and 6. That split, the 3-6 pair split it relative to the 4-5 pair split varies from termination to termination and becomes a major source of variation for plug performance. In addition, conductor pair sequence from one end of the cable to the other end of the cable changes from clockwise to counter-clockwise which results in the 3-6 conductors being on top on one end and on bottom at the other end. Due to the 3-6 conductor pair position in a cable, 3-6 conductor pair transition relative to 4-5 conductor pair varies from one end of the cable to the Other end of the cable and that introduces variation in plug performance. Conductor position relative to coupling conductors and coupling conductor length influences plug performance. Plug performance varies with conductor gage, conductor dielectric material thickness and material electrical property.

SUMMARY OF THE INVENTION

In one embodiment, the present invention is an RJ45 plug that features a plug housing having preassembled plug contacts, a termination block assembly and a strain-relief boot. The termination block can feature integral lead frame contacts having IDCs at one end for wire termination and plug contact interface at the other end. The plug contacts can be factory assembled and allow for consistent crimp depth. One end of plug contact can include an interference slot to connect with the termination block lead frame contact interface end. In one embodiment, the planes passing through center of interference slots, center of plug housing opening that receives the termination block, center of termination block vertical height, and thru center of termination block lead frame contact interface end thickness are the same. IDCs for pairs 1-2 and 7-8 are positioned on sides while IDCs for pairs 4-5 and 3-6 are positioned on top and bottom. Termination block lead frame contacts are designed to have contact 3 coupling with contacts 1, 2, 4 and 5 is same as contact 6 coupling with contacts 7, 8, 5 and 4. This allows termination block to be rotated 180 degrees along the cable axis so IDCs 3-6 are on same side as conductors 3-6 on cable. With 180 degree rotation termination block lead frame contacts 1, 2, 3, 4, 5, 6, 7, 8 becomes pins 8, 7, 6, 5, 4, 3, 2, 1 respectively. Termination block features wire pair separators and a cross divider. Pair separator facilitates minimum pair untwist for termination. The cross divider is pushed under the cable jacket for separation of conductor pairs. IDCs are positioned to minimize coupling between the pairs. Coupling needed for desired plug performance is achieved by coupling in the fixed contacts closer to plug/jack mating point located outside of the signal current path. IDCs are designed to terminate multiple gauge solid or stranded conductors, both allows one plug design that is suitable for different cable designs.

DETAILED DESCRIPTION OF THE PREFERRED EMBODIMENTS

Figure 1:
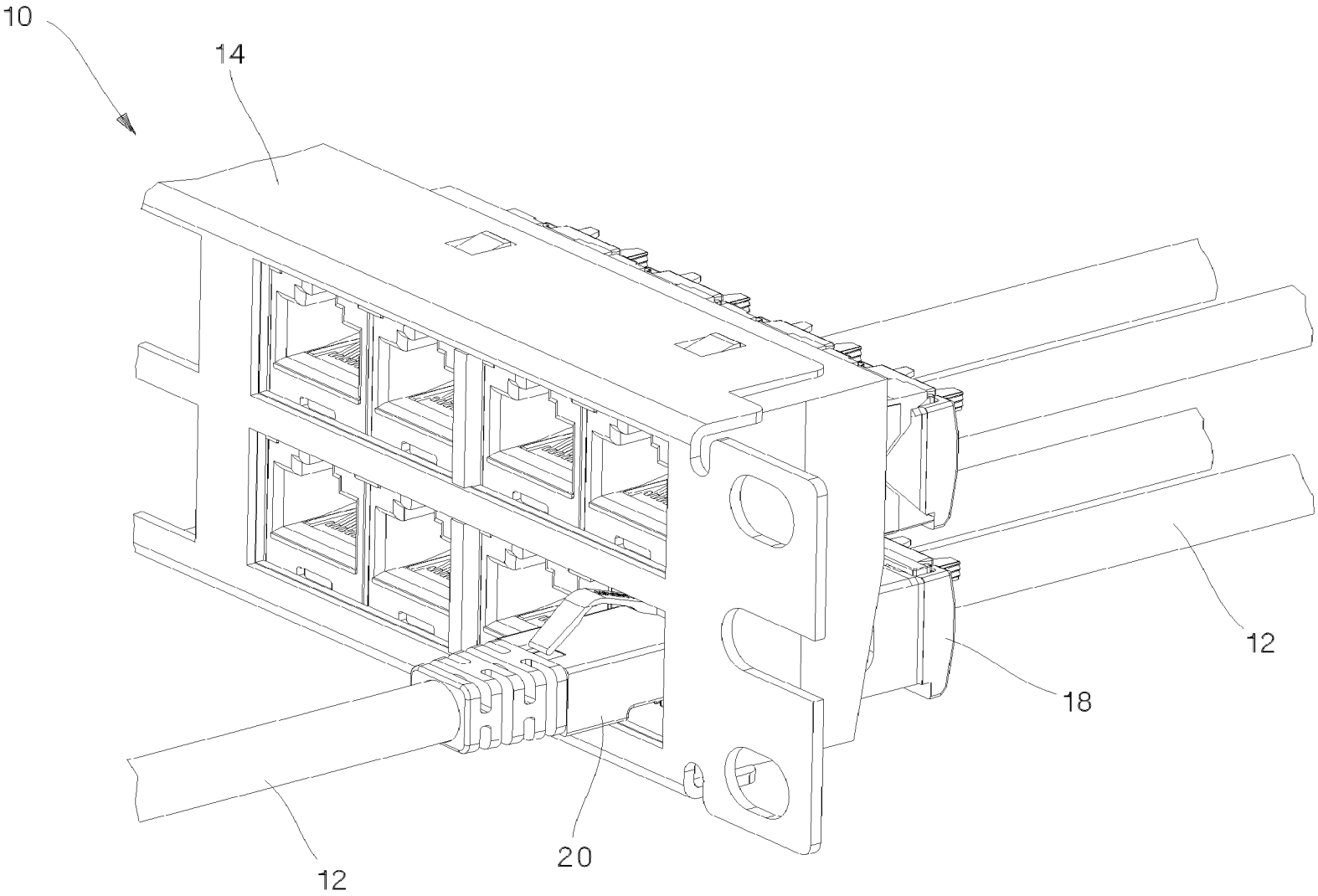
FIG. 1 is an isometric view of a communication system in which a high performance plug may be used.
Figure 2:
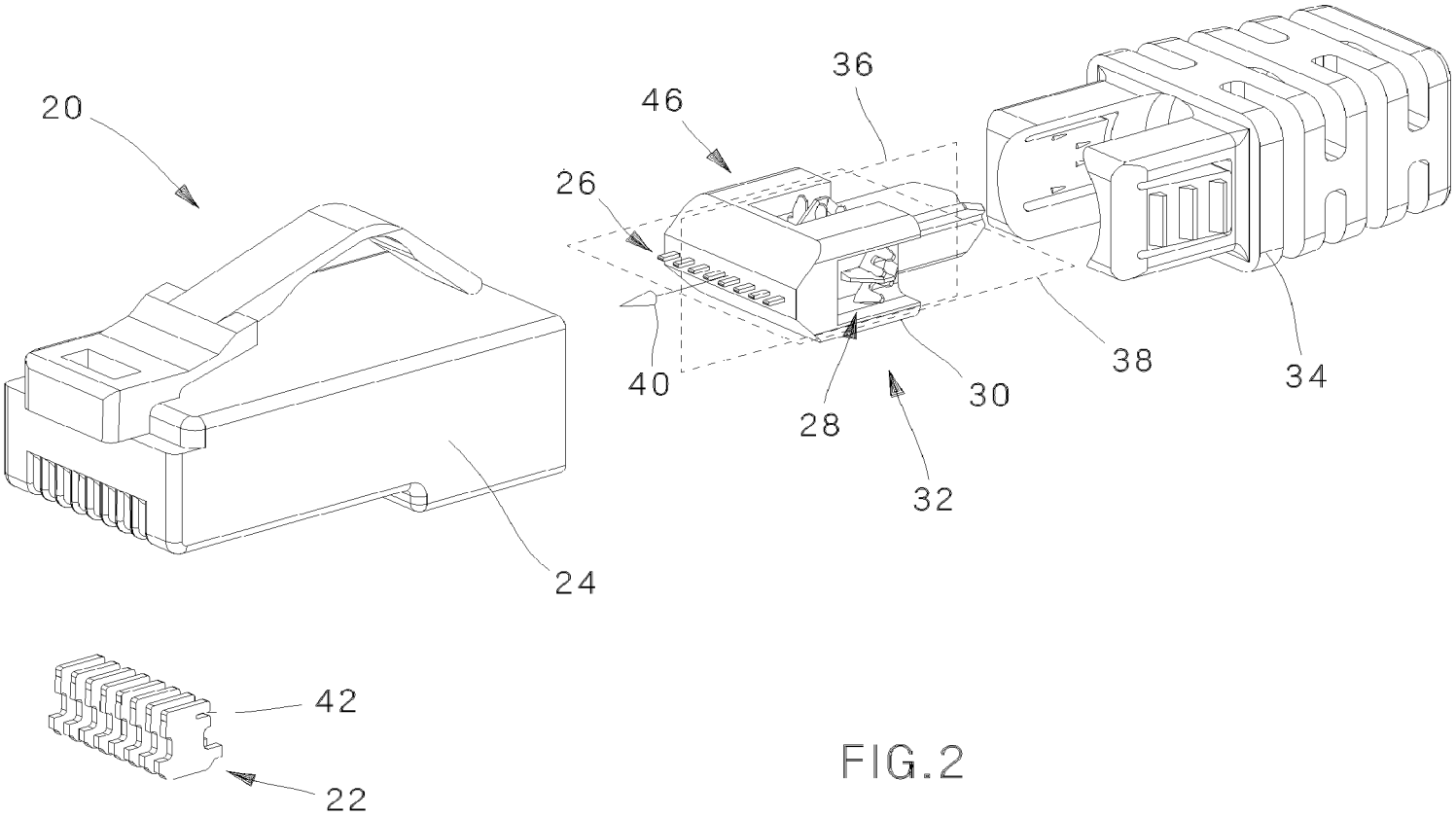
FIGS. 2 and 3 are exploded isometric views of a first embodiment of a high performance plug.
Figure 3:
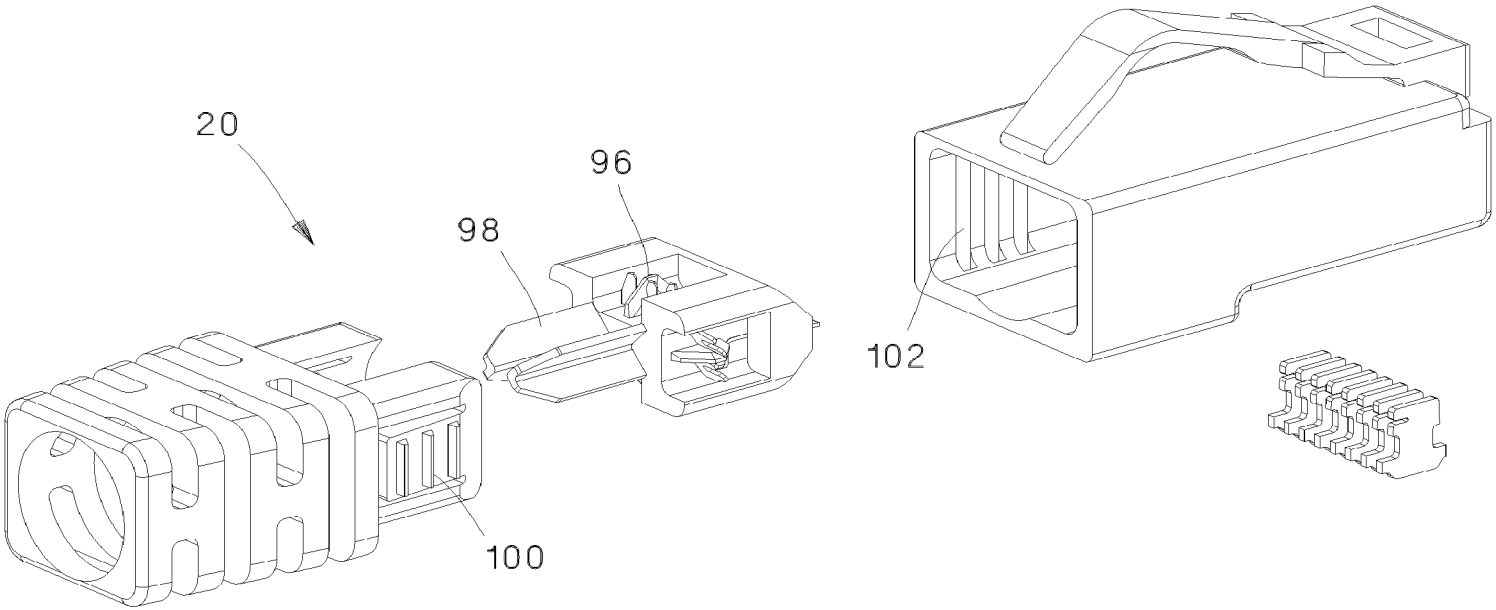

A communication system 10 according to an embodiment of the present invention is shown in FIG. 1 and includes at least one communication cable 12, connected to equipment 14. Equipment 14 is illustrated as a patch panel in FIG. 1, but the equipment can be passive equipment or active equipment. Examples of passive equipment can be, but are not limited to, modular patch panels, punch down patch panels, coupler patch panels, wall jacks, etc. Examples of active equipment can be, but are not limited to, Ethernet switches, routers, servers, physical layer management systems, and power-over Ethernet (POE) equipment as can be found in data centers and/or telecommunication rooms; security devices (cameras and other sensors, etc.) and door access equipment; and telephone, computers, fax machines, printers and other workstation peripherals. Communication system 10 can further include cabinets, racks, cable management and overhead routing systems and other such equipment.

Plug 20, including eight contacts 22, is connected to respective twisted pair conductors in cable 12 and mates with respective jack 18 in patch panel 14. Although jacks 18 are shown as modular jacks, they can be punch down or other types of jacks. A CAT6A communication system 10 is shown in FIG. 1; however, communication system 10 according to the present invention can be configured for use in any CAT5E, CAT6, CAT6A, CAT7, CAT7A, and CAT8 or other category communication system standard by the appropriate selection of applicable standard compliant plugs, jacks, cable and equipment.

FIGS. 2-8 show a first embodiment of a high performance plug. Plug 20 is shown exploded in FIGS. 2 and 3. Plug housing 24 is assembled with contacts 22. Contacts 22 feature slots 42. Termination block 32 includes plastic housing 30 that encloses contacts 46. Contacts 46 feature termination point 28, in this case termination point 28 is an insulation displacement contact (IDC), and contact interface 26. Horizontal plane 38 and vertical plane 36 divides termination block 32 and plug housing 24 inside opening vertically and horizontally respectively. Axis 40 passes through intersection of planes 36 and 38. Cable 12 conductor pairs are terminated at termination points 28. Individual interface 26 mates with respective contact 22 at slot 42. Plug boot 34 provides cable strain relief, cable bend radius control, and keeps termination block 32 pushed forward. Plug boot 34 features teeth geometry 100. Plug housing feature 102 engages with boot teeth geometry 100. Multiple teeth increases the retention force.

For termination, cable 12 jacket is stripped, conductors 44 pairs are bent outward, the cable 12 crossweb is cut flush (if present), termination block 32 is rotated to align 3-6 IDCs with the 3-6 cable pair, cross divider 98 is pushed between the cable pairs around the cable cross-web, twisted pair proper conductor is aligned on appropriate IDC by adding or removing a twist and pushing the conductors over the pair separator 96 and into the IDC slot. Excess conductors 44 lengths are cut to finish the assembly.

Figure 4:
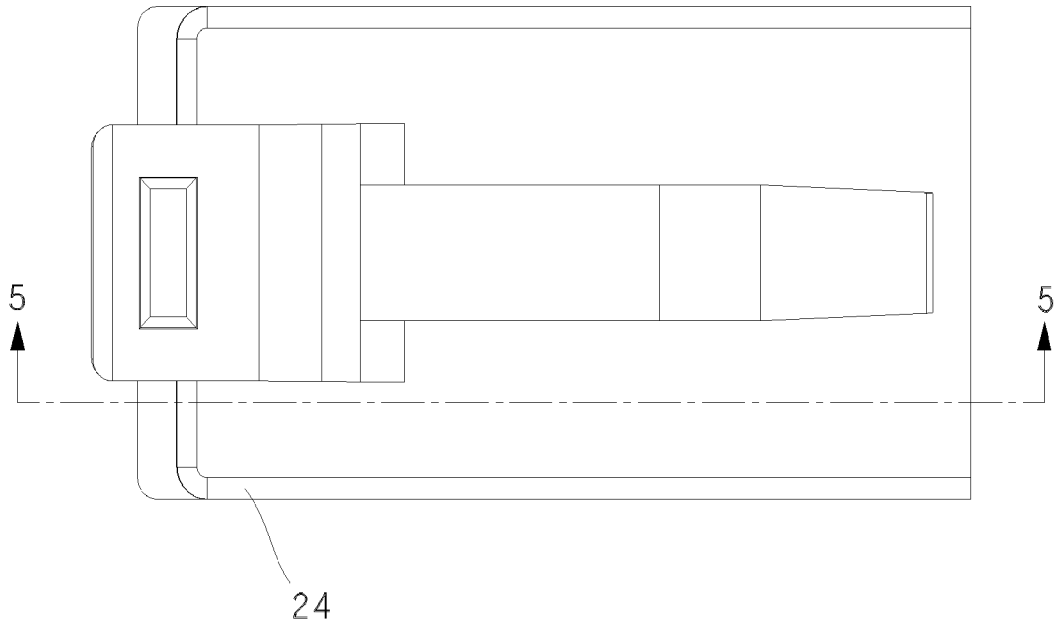
FIG. 4 is a top view of the high performance plug of FIG. 2.

FIG. 4 illustrates plug assembly 20 top view showing section line 5-5 passing through contact 22 thickness centerline. In this view, plug boot 34 is not shown.

Figure 5:
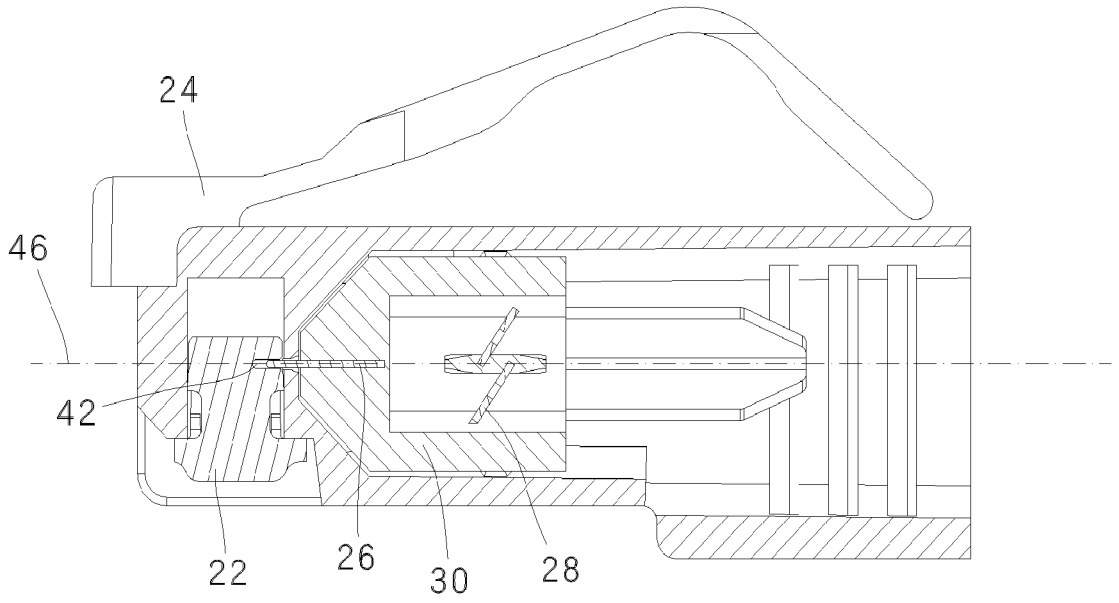
FIG. 5 is a cross-sectional view taken along line 5-5 of FIG. 4 of the high performance plug of FIG. 2.

FIG. 5 is a cross-sectional view taken about line 5-5 in FIG. 4 and illustrates centerline 46 located on plane 38 that passes through center of slot 42 height, contact 26 thickness, termination block housing 30 height, and plug housing 24 inside opening height centerline.

Figure 6:
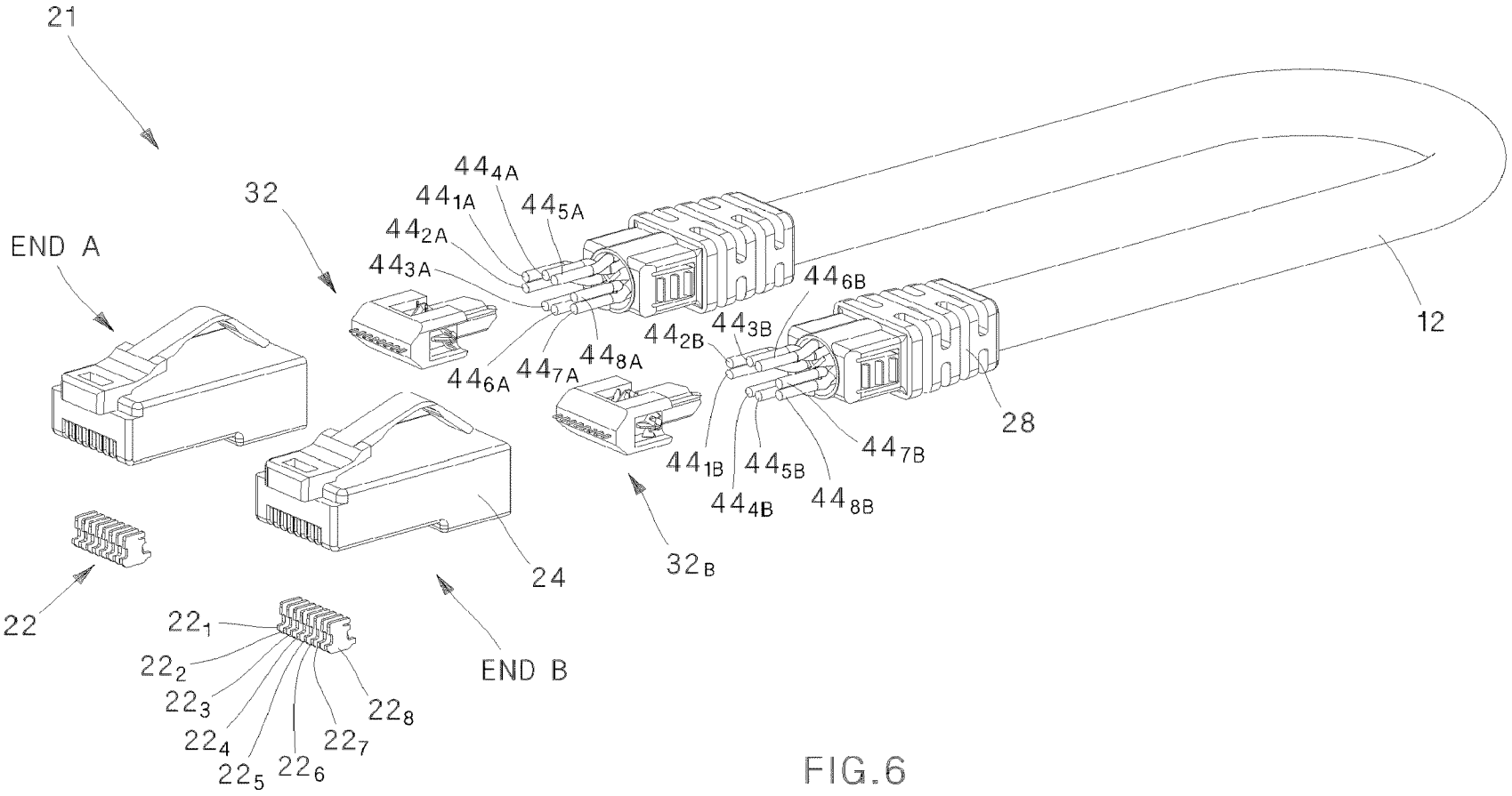
FIG. 6 is an exploded isometric view of a patch cord using the high performance plugs of FIG. 2.

A patch cord 21 isometric view with exploded plug ends is illustrated in FIG. 6. The subscript letters next to component ID depict corresponding cable end and the subscript numbers next to component ID represent RJ45 pin positions as defined by ANSI/TIA-568-C.2. The cable end A conductors 44 are in a counterclockwise order with conductors $\mathbf{44}_{4A}$ and $\mathbf{44}_{5A}$ on top. The cable end B conductors 44 are in clockwise order with conductors $\mathbf{44}_{4B}$ and $\mathbf{44}_{5B}$ on bottom.

Figure 7:
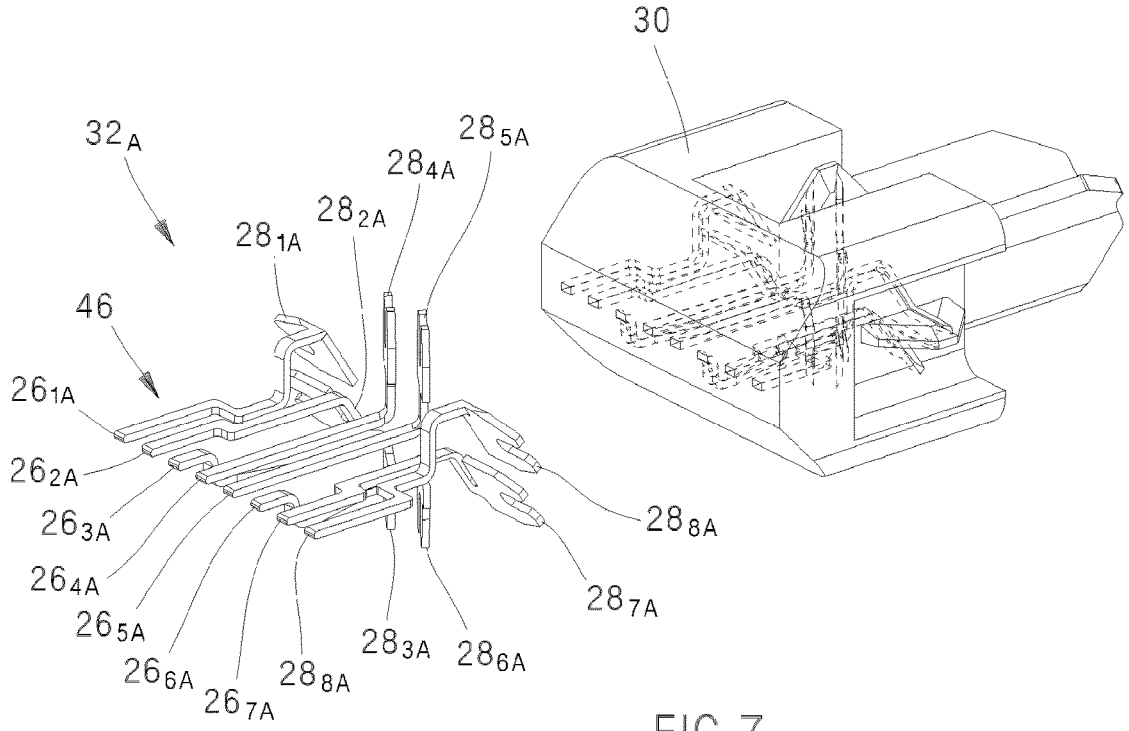
FIGS. 7 and 8 are exploded isometric views of a termination block for the high performance plug of FIG. 2.
Figure 8:
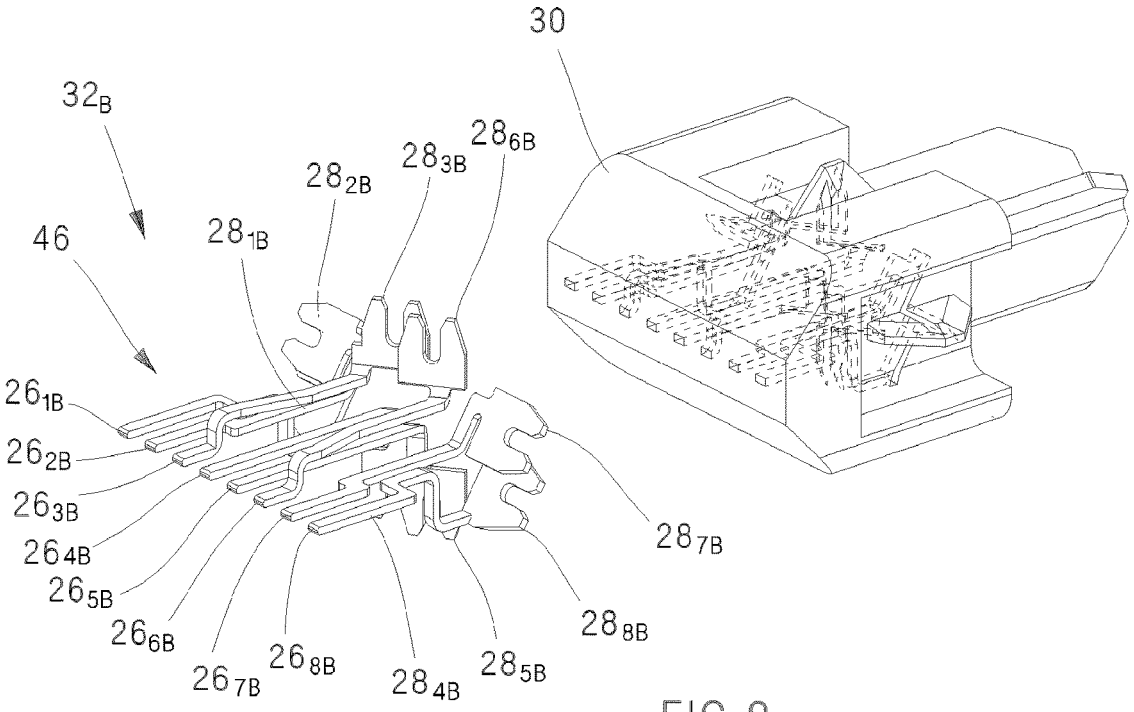

Termination block 32A exploded view is illustrated in FIG. 7. IDCs $\mathbf{28}_{4A}$ and $\mathbf{28}_{5A}$ are on top while IDCs $\mathbf{28}_{3A}$ and $\mathbf{28}_{6A}$ are on bottom at this end. FIG. 8 illustrates End B termination block 32B exploded view. IDCs $\mathbf{28}_{4B}$ and $\mathbf{28}_{5B}$ are on bottom while IDCs $\mathbf{28}_{3B}$ and $\mathbf{28}_{6B}$ are on top at this end. The termination block 32A is rotated 180 degrees around axis 40 to have 32B orientation. Contact 3 coupling with adjacent contacts 1, 2 and 4 is same as contact 6 coupling with contacts 5, 7 and 8.

Figure 9:
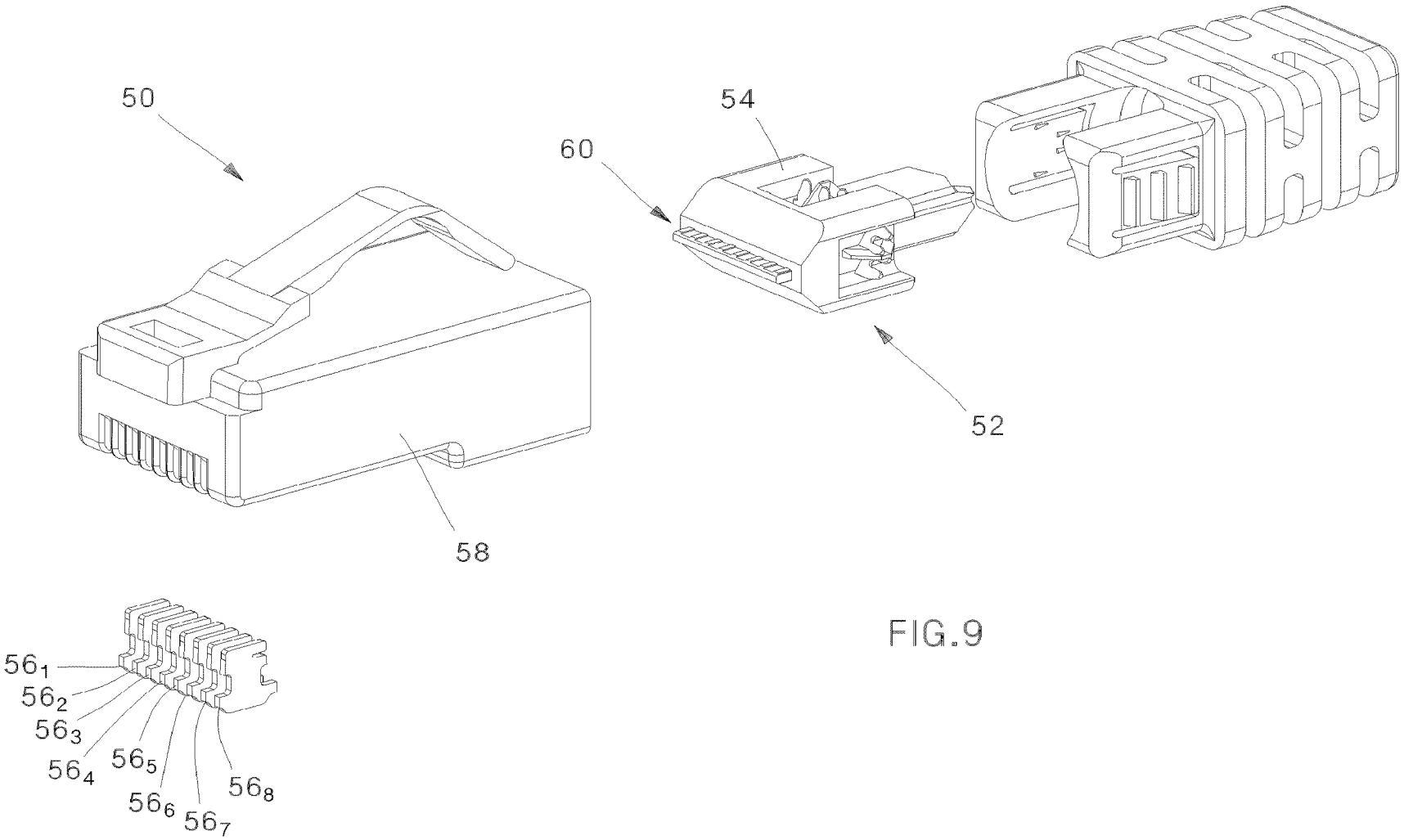
FIG. 9 is an exploded isometric view of a second embodiment of a high performance plug.
Figure 10:
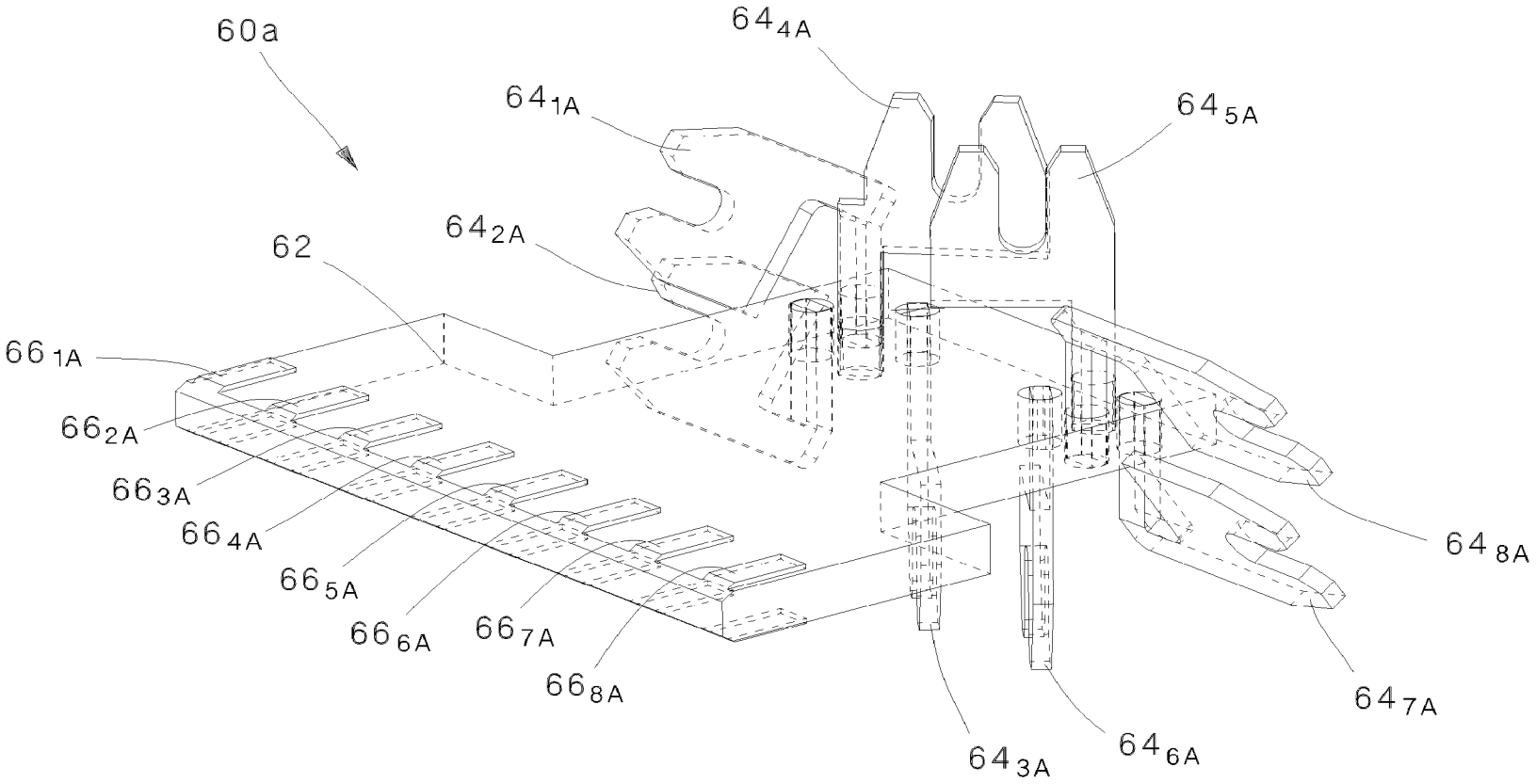
FIGS. 10 and 11 are isometric views of a PCB assembly to be used with the termination block of the high performance plug of FIG. 9.
Figure 11:
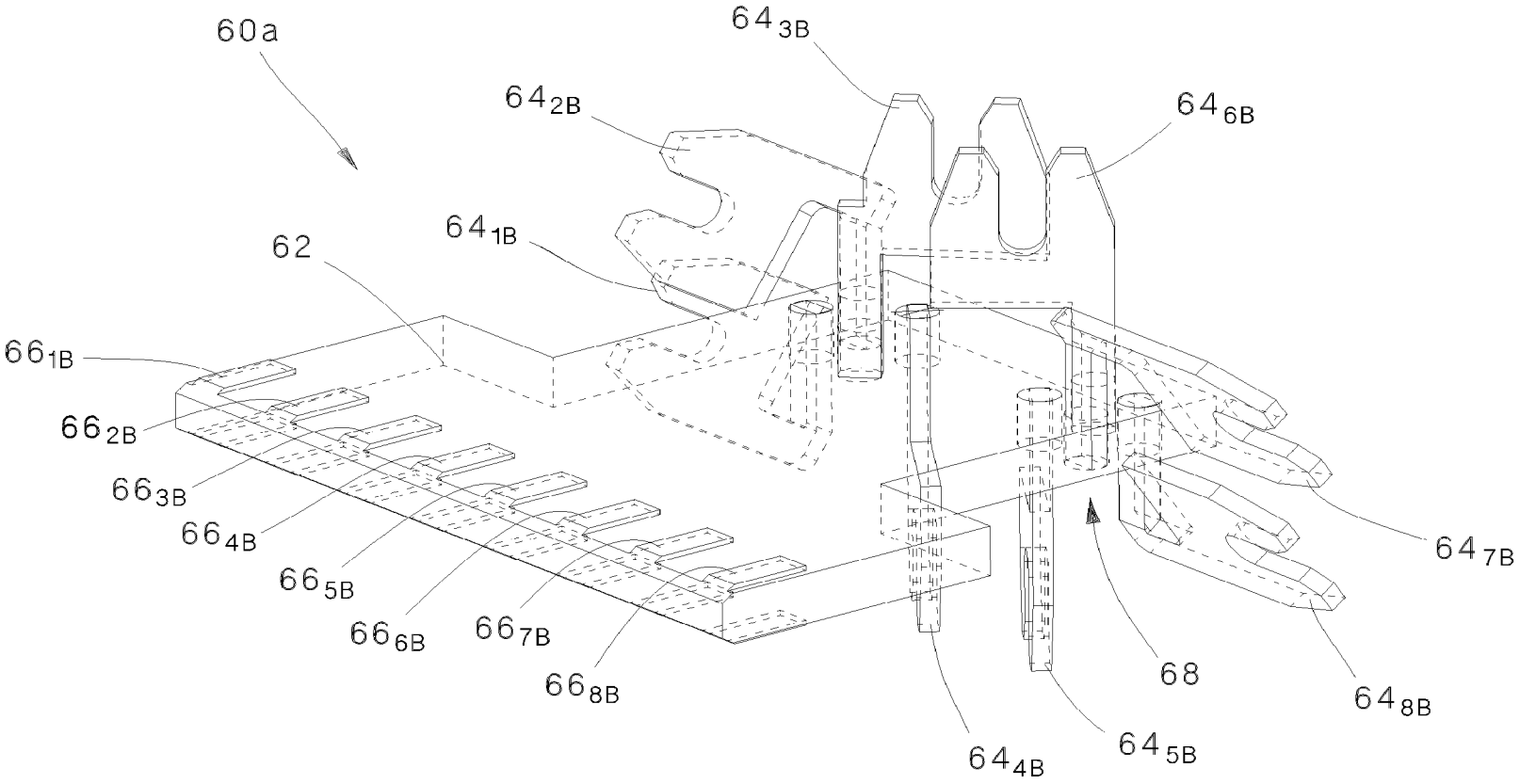

Referring to FIG. 9, there is illustrated an alternate embodiment 50 with termination block 52, termination block housing 54, printed circuit board (PCB) assembly 60 and interface contacts 56. FIGS. 10 and 11 shows PCB assembly 60A and 60B respectively. PCB 62 features interface pads 66 and IDCs 64. Interface pads 66 are on top and bottom side of the PCB 62 to have a redundant connection with contacts 56. PCB 62 features artwork connecting contact 3 coupling with the artwork connecting contacts 1, 2, 4 and 5 the same as artwork connecting contact 6 coupling with the artwork connecting contacts 7, 8, 5 and 4. This allows one termination block design that can be used for both cable ends with an end rotated by 180 degrees, when compared to the other end, around axis 40 to align 36 pair.

Figure 12:
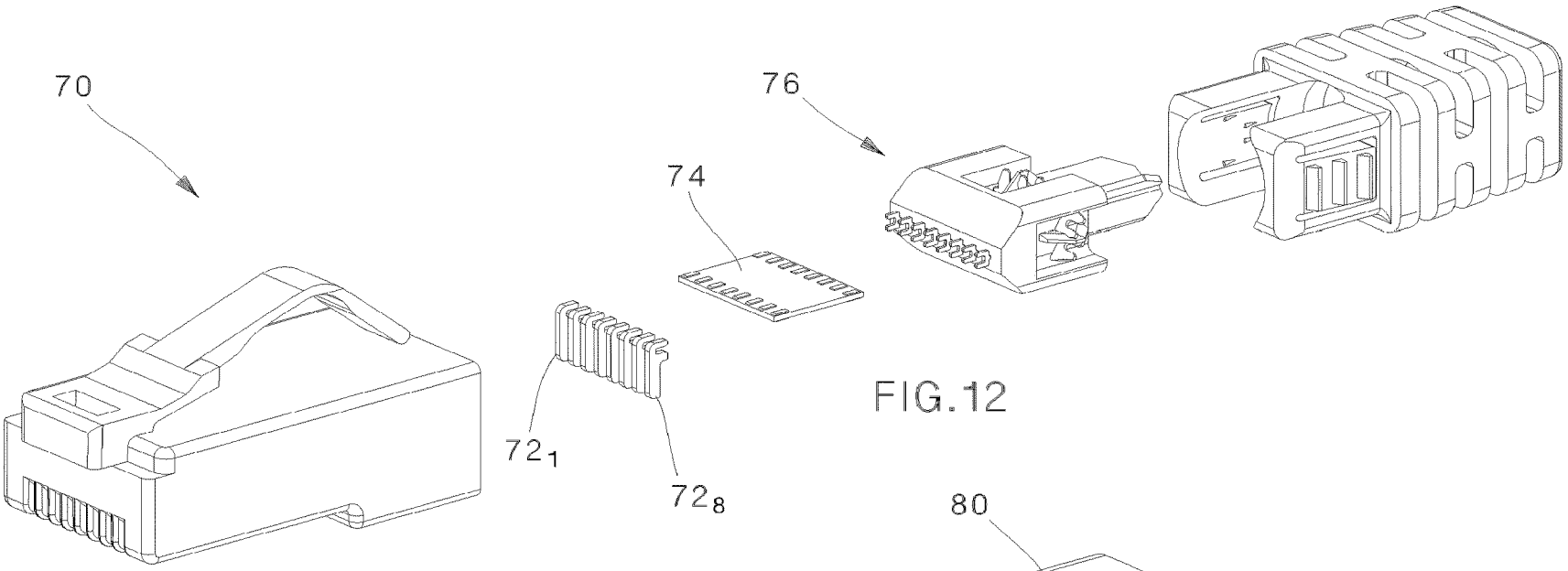
FIG. 12 is an exploded isometric view of a third embodiment of a high performance plug.
Figure 13:
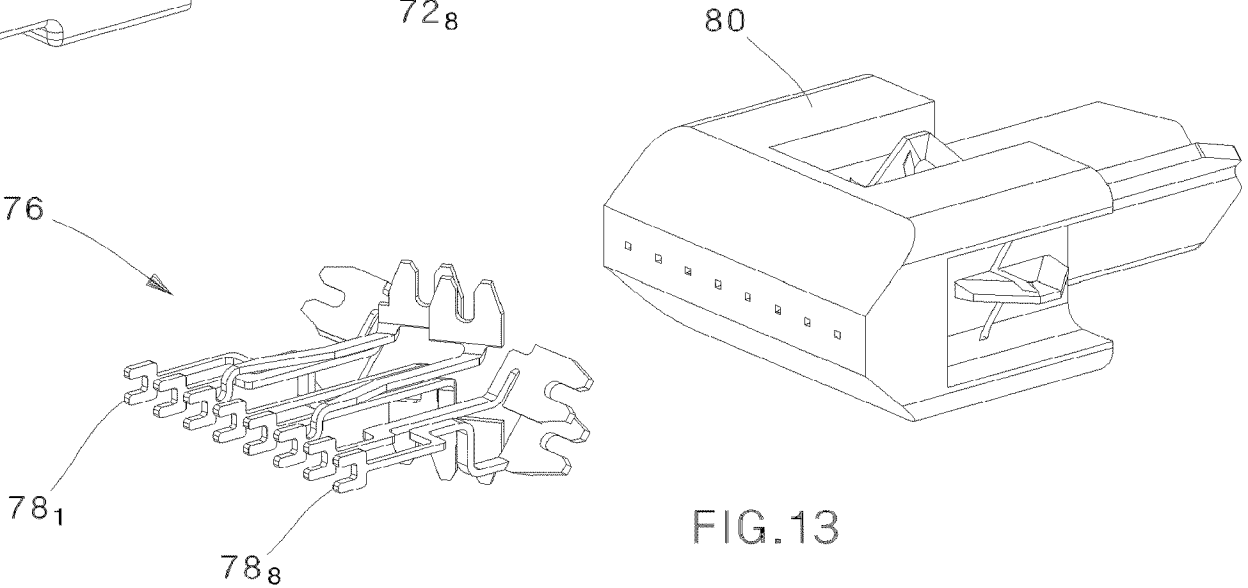
FIG. 13 is an exploded isometric view of a termination block for the high performance plug of FIG. 12.

FIGS. 12 and 13 illustrate another embodiment 70 having termination block 76, PCB 74, termination block housing 80 and interface contacts 72. Termination block IDC contact PCB interface ends 78 features an interference design that slides over the PCB pads and establishes a connection. Contacts 72 are made smaller to minimize the coupling and coupling variation.

Figure 14:
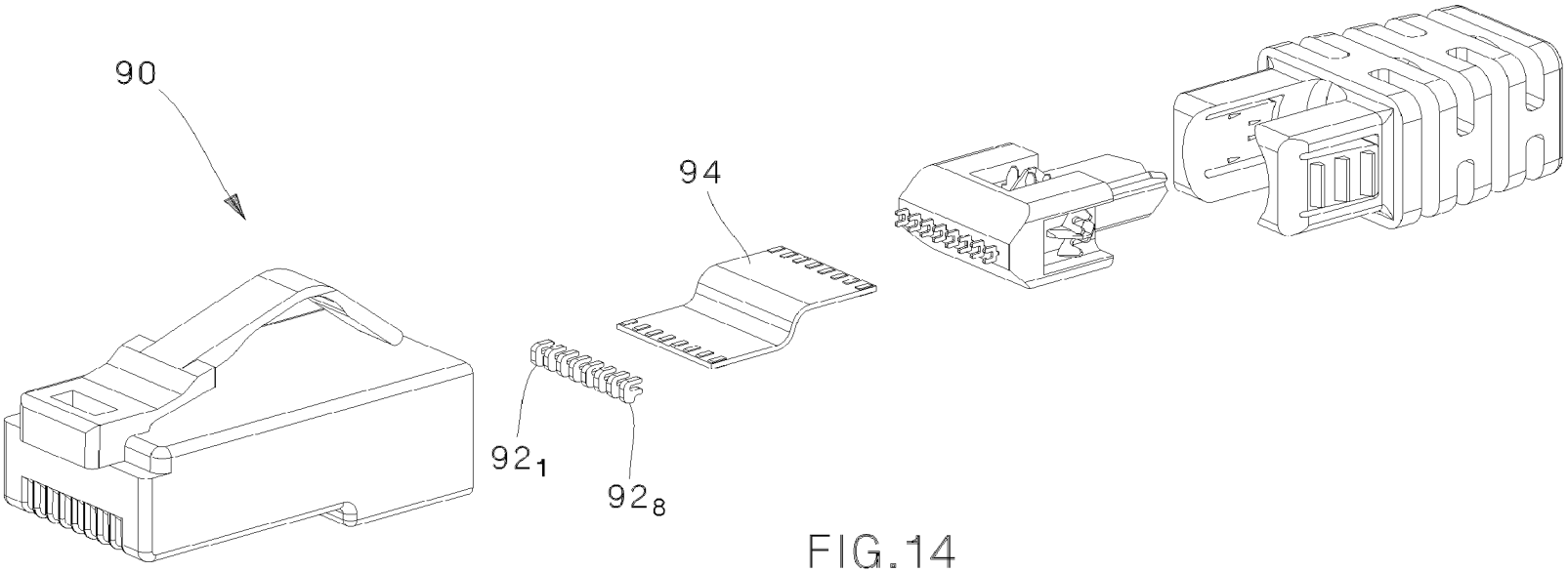
FIG. 14 is an exploded isometric view of a fourth embodiment of a high performance plug.
Figure 15:
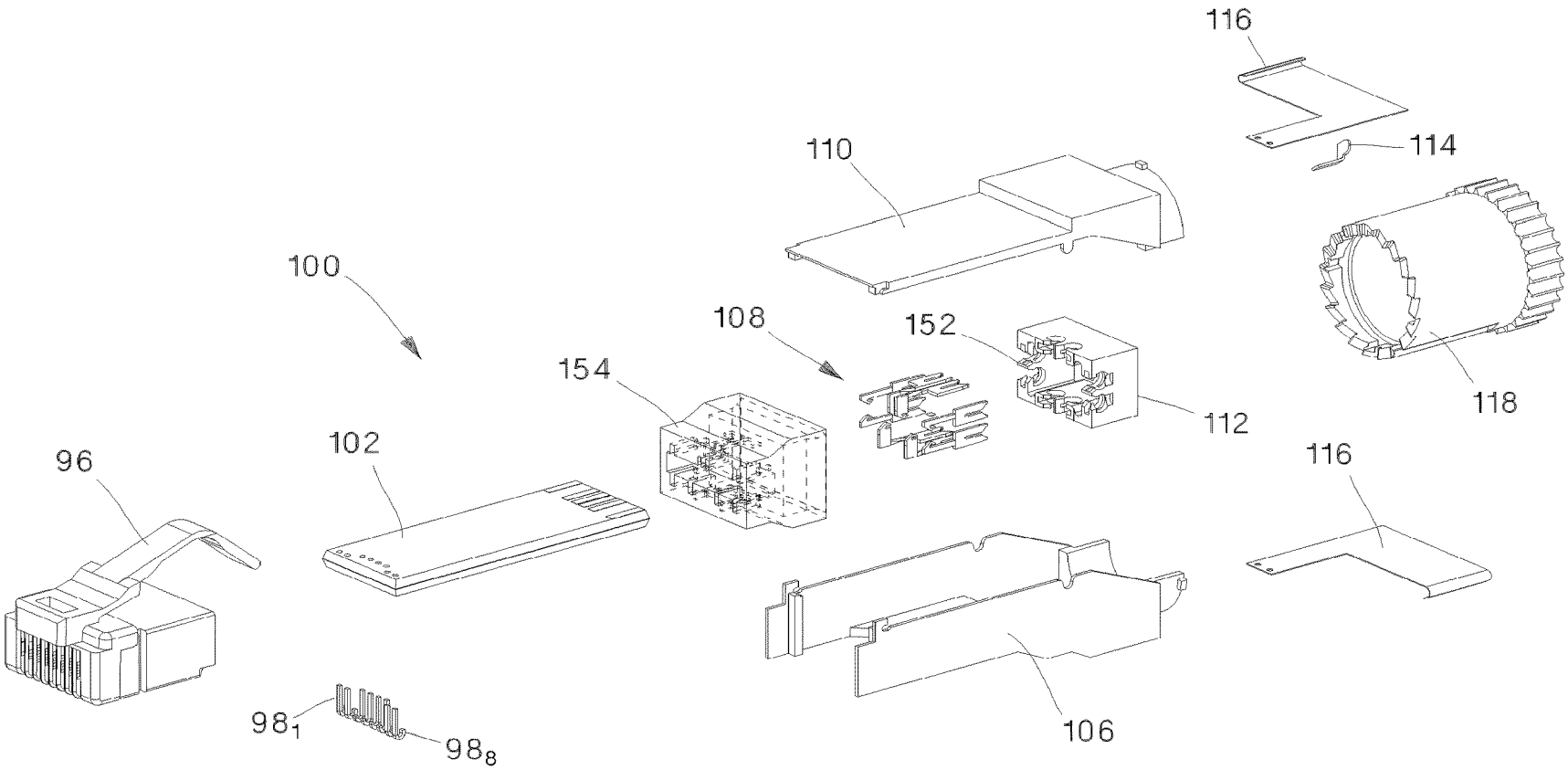
FIG. 15 is an exploded isometric view of a fifth embodiment of a high performance plug.

FIG. 14 illustrates another embodiment 90 having flexible PCB 94 and smaller interface contacts 92. Smaller interface contact design reduces variation and allows precise crosstalk/compensation placement on PCB near plug jack mating point outside of the signal current path. PCB 94 can be Rigid Flex PCB.

FIGS. 15 to 23 illustrate alternate embodiment 100 with plug housing 96, PCB 102, plug contacts 98, termination block housing 154, IDCs 108, wire manager 112, bottom shell 106, top shell 110, collar 118, collar stop 114 and strain relief straps 116. Plug interface contacts 98 are electrically connected to PCB 102. PCB pads 122 are connected to respective plug contacts 98 via connecting traces. PCB 102 includes traces and coupling circuitry for crosstalk and return loss tuning; PCB circuitry is not shown. Termination block 104 is an assembly of termination points (IDCs being shown in the figures) 108 and termination block housing 154 using mechanical assembly or insert molding or like processes. IDC 108 feature insulation displacement slot geometry at wire manager interface end and wiping contact 126 at PCB pad 122 interface (other types of termination points other than IDCs and wiping contacts may be used). Strain relief straps 116 are mechanically and electrically connected to shells 106 and 110. Collar stop 114 is connected to top shell 110. Wire manager 112 features wire pair separator 152. Bottom shell 106, top shell 110 and strain relief collar 118 are made using conductive material for shielded connector. Strain relief straps 116 and collar stop 114 are made using spring material. PCB pads 122 for contact positions 3, 4, 5 and 6 are located on both top and bottom surface of the PCB 102. When cable 12 conductors $\mathbf{124}_1/\mathbf{124}_2$ are aligned to plug left and conductors $\mathbf{124}_7/\mathbf{124}_8$ are aligned with plug right side, conductors $\mathbf{124}_3$ and $\mathbf{124}_6$ are either on top or bottom.

Figure 16:
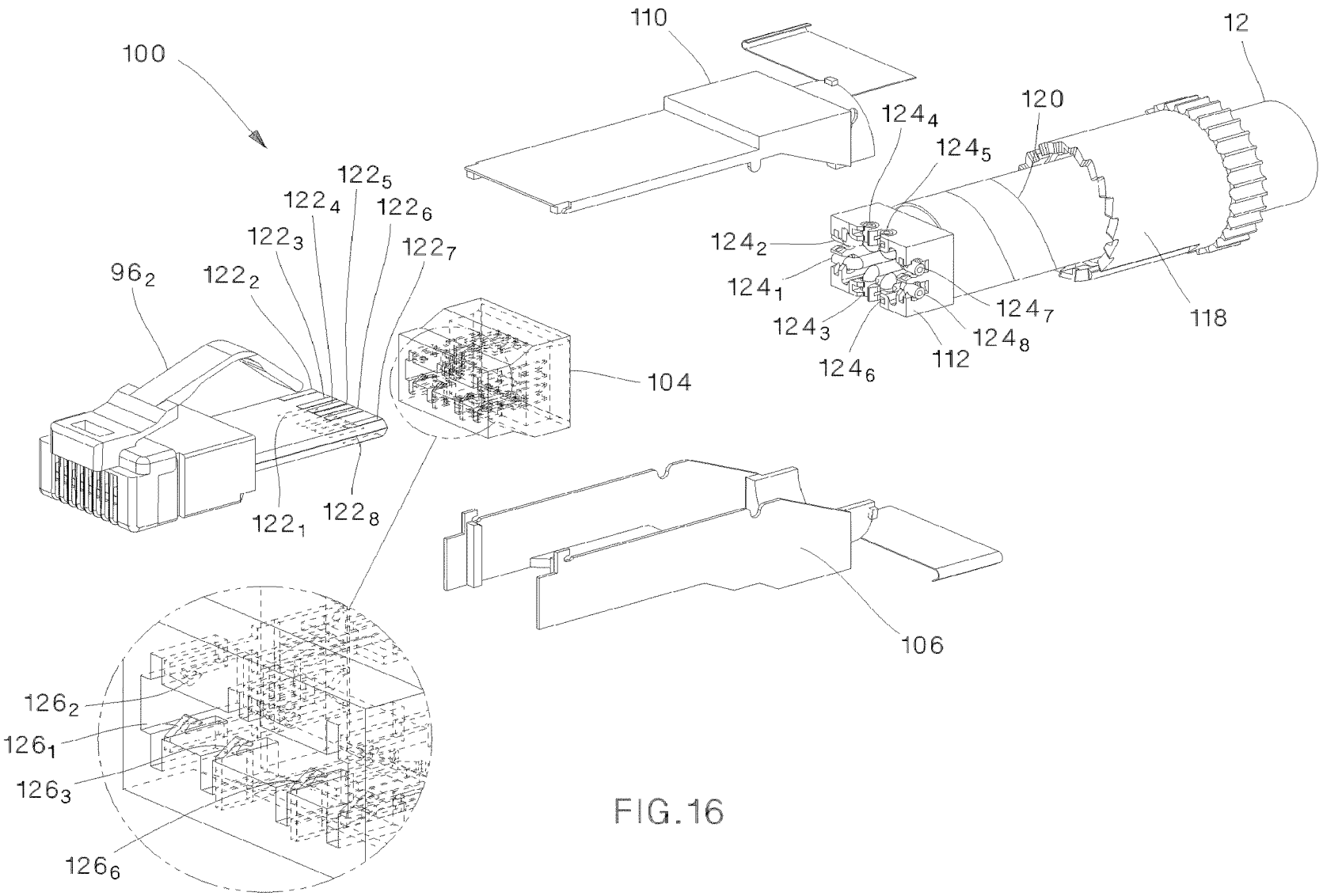
FIG. 16 is another exploded isometric view of the high performance plug of FIG. 15 with a magnified view of the block housing and focusing on the termination of a cable to the high performance plug.
Figure 17:
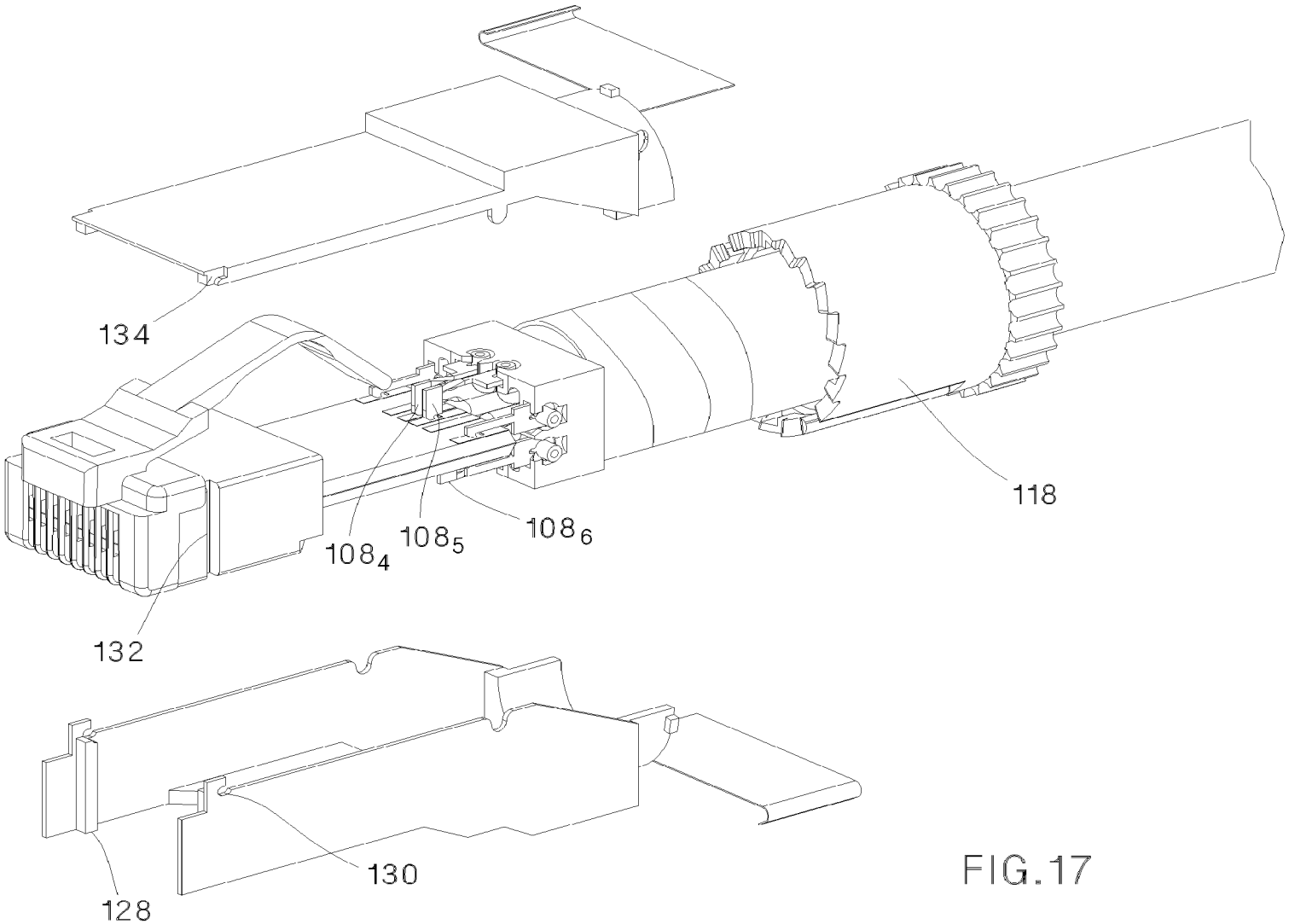
FIG. 17 is another exploded isometric view of the cable and plug arrangement of FIG. 16

FIGS. 16 and 17 illustrate cable 12 end that has conductors $\mathbf{124}_3$ and $\mathbf{124}_6$ on bottom. For termination, collar 118 is threaded onto cable 12, drain wire 120 is wrapped around the jacket, if braid exists, it is pulled back over the cable jacket. Cable pairs are threaded through wire manager 112 and pulled over pair separator after aligning conductors $\mathbf{124}_1/\mathbf{124}_2$ on left and $\mathbf{124}_7/\mathbf{124}_8$ on right. Conductors $\mathbf{124}_3/\mathbf{124}_6$ and $\mathbf{124}_4/\mathbf{124}_5$ are pulled into bottom and top wire slots respectively. Termination block is rotated to match 3/6 IDC with conductors $\mathbf{124}_3/\mathbf{124}_6$ and pushed over wire manger to terminate wires. Termination block interface 126 is pushed over the PCB 102 to make contact at PCB pad 122.

Figure 18:
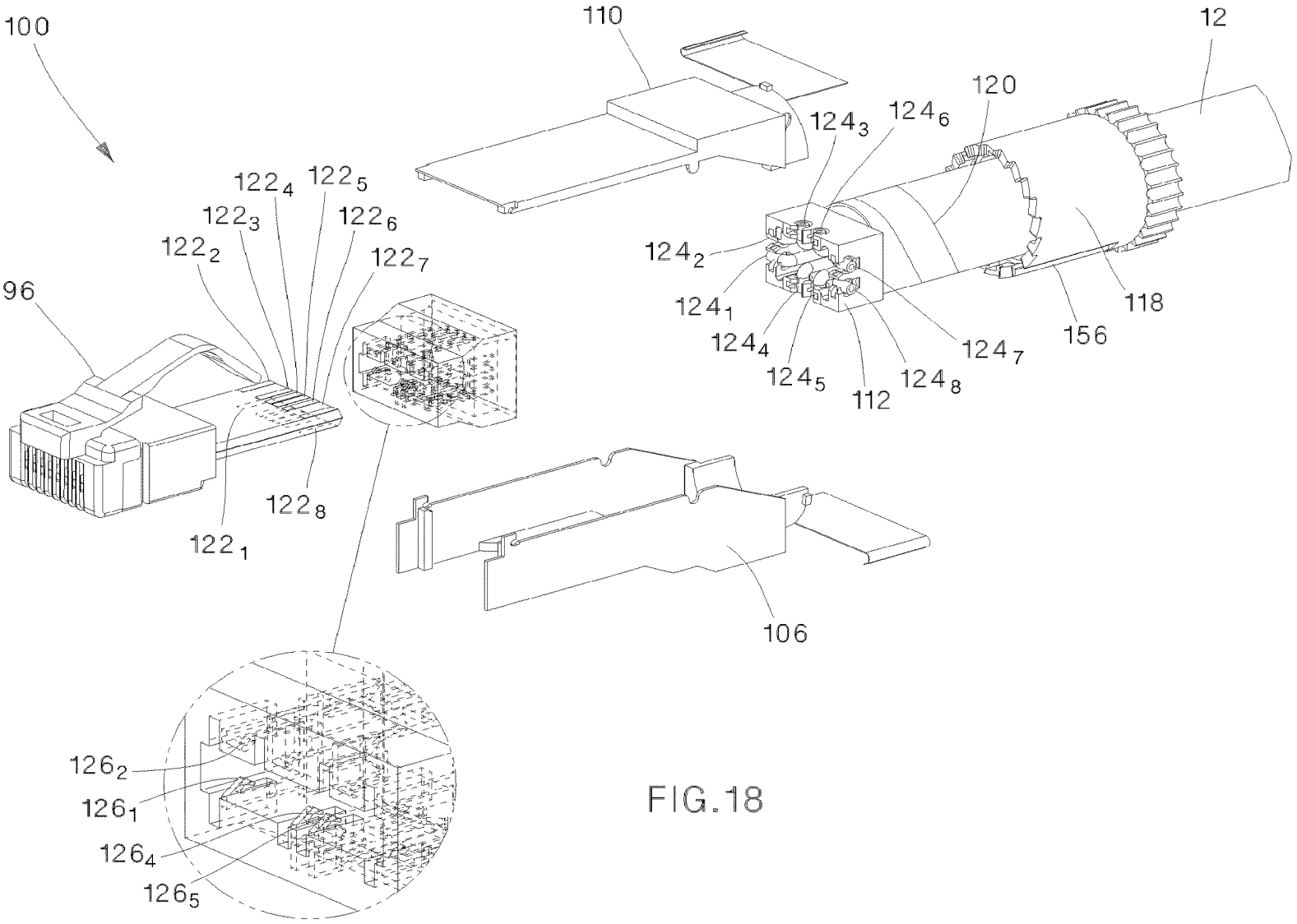
FIG. 18 is an exploded isometric view of the high performance plug of FIG. 15 with a magnified view of the block housing and focusing on the termination of the opposite end of the cable of FIG. 16 to the high performance plug.
Figure 19:
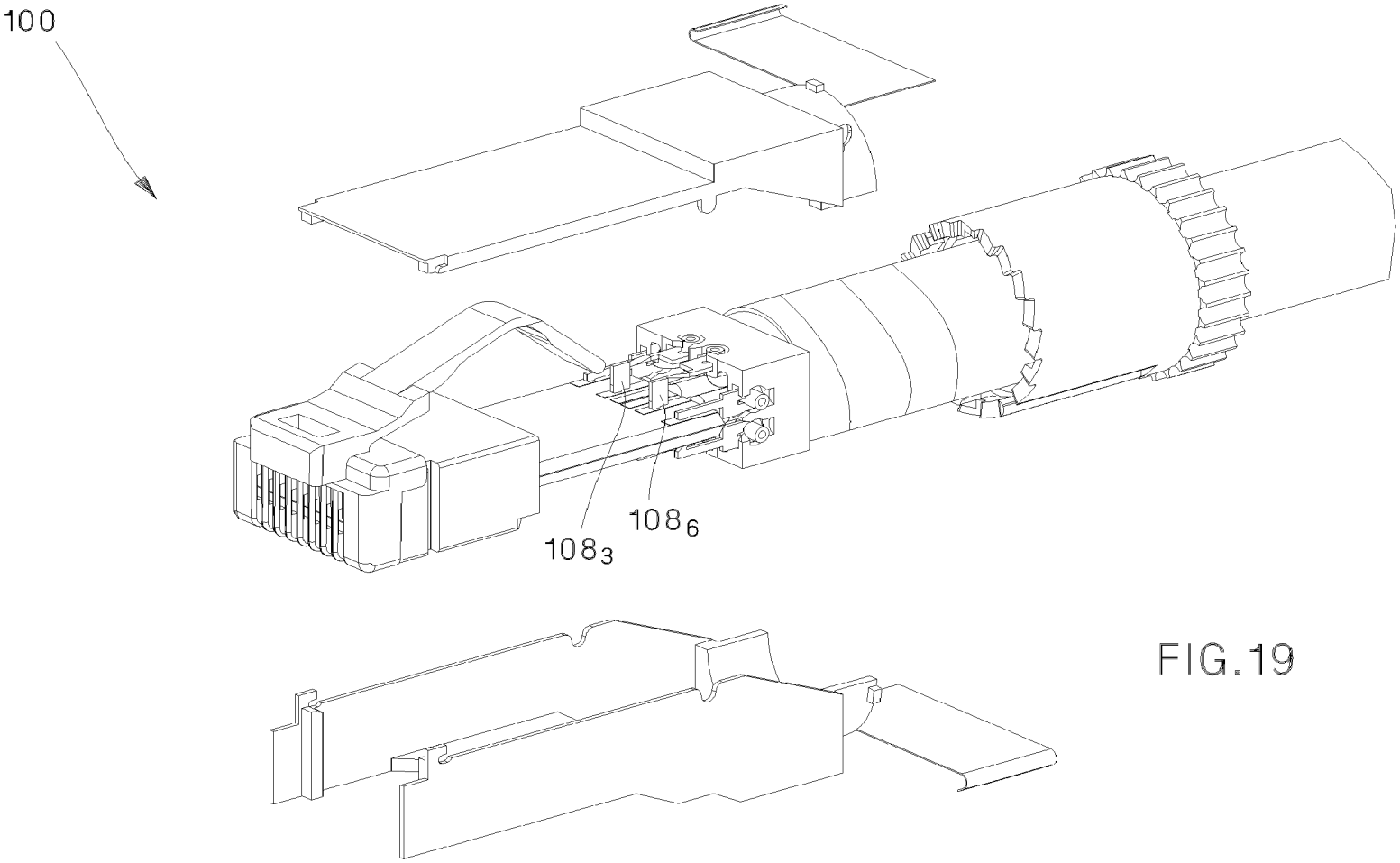
FIG. 19 is another exploded isometric view of the cable and plug arrangement of FIG. 18.

FIGS. 18 and 19 illustrate termination at cable 12 other end where conductor $\mathbf{124}_3$ and $\mathbf{124}_6$ are on top.

Figure 20:
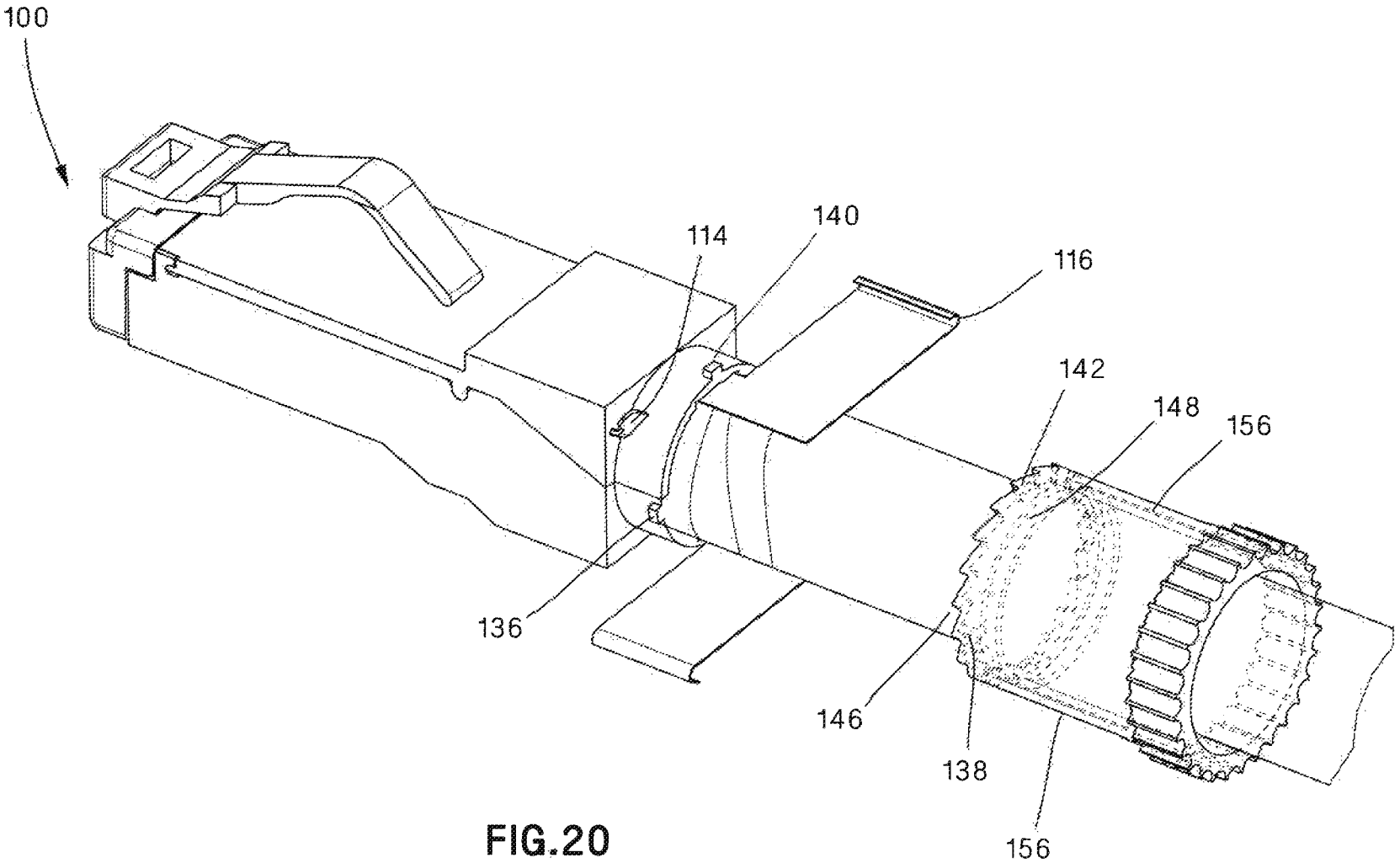
FIGS. 20-22 are isometric views of the high performance plug and cable assembly of FIGS. 16-19 showing how the collar is affixed to the high performance plug.
Figure 21:
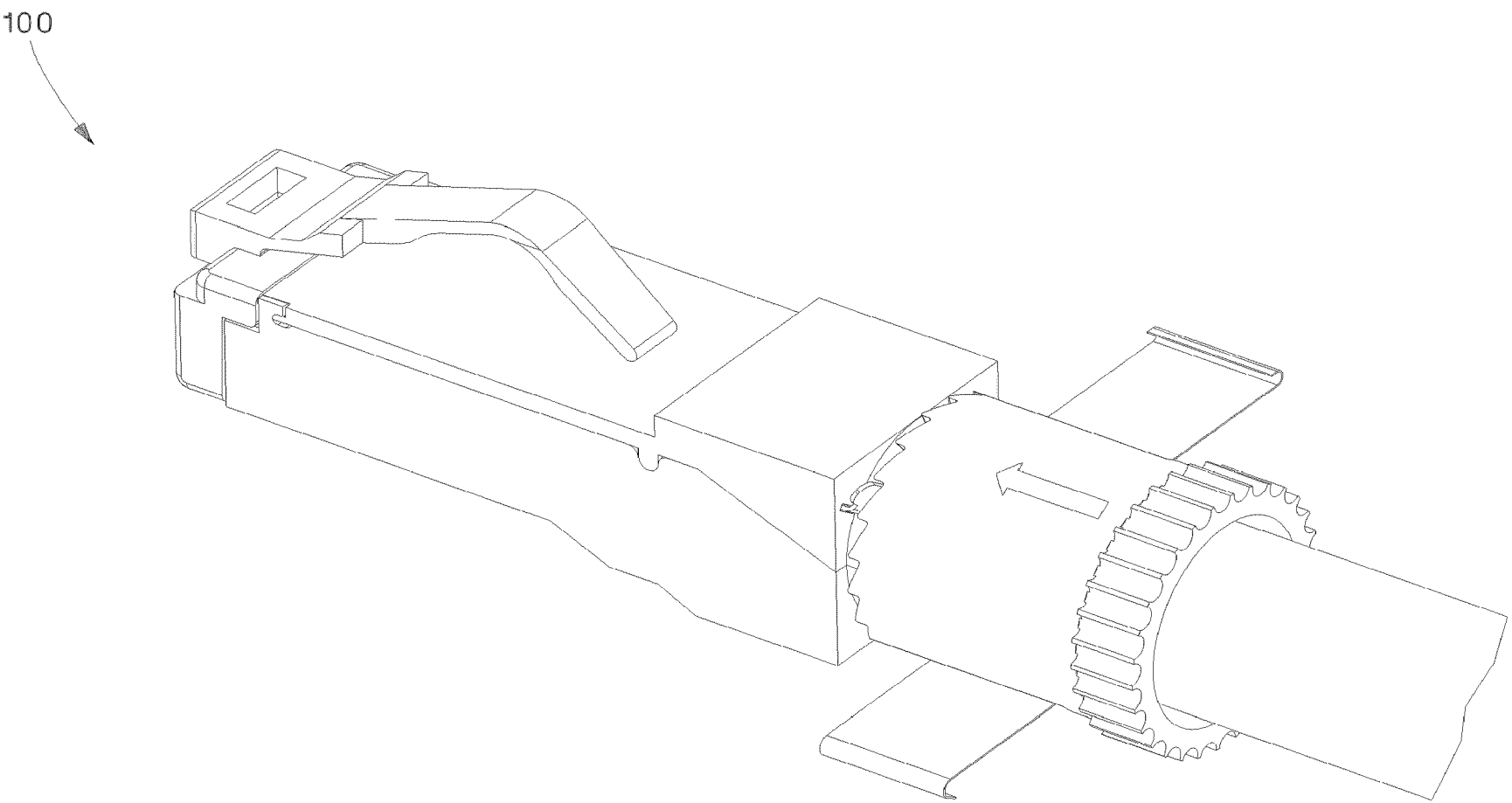
Figure 22:
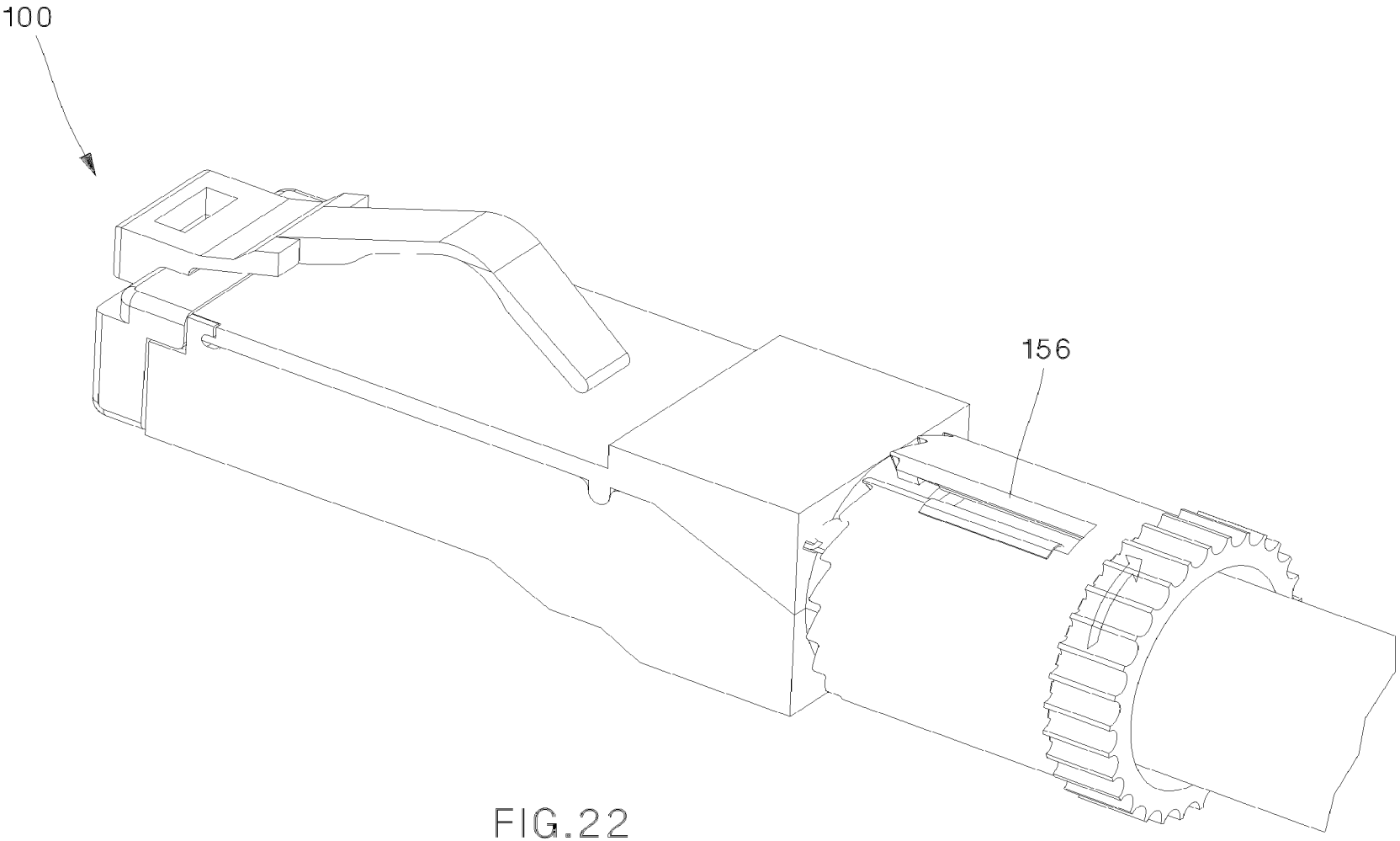
Figure 23:
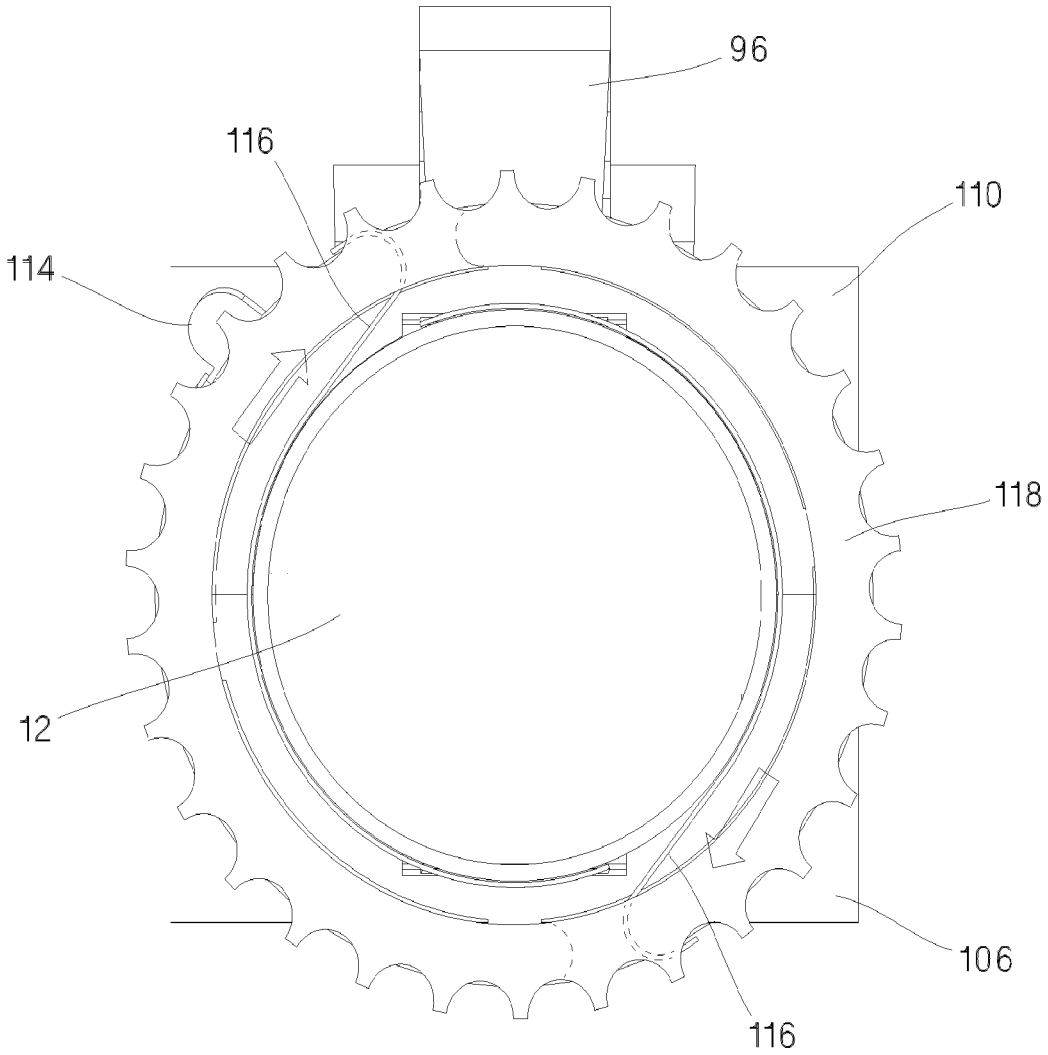
FIG. 23 is an end view of the high performance plug of FIG. 15 with the collar attached.

FIG. 20 illustrate plug housing 96 assembled to bottom shell 106 and top shell 110. Collar 118 includes slots 138 and 142 that allow collar 118 assembly over shell pads 136 and 140. Bottom shell rails 128 slide into plug housing slots 132 to locate plug contacts 98 and wire terminations in a fixed position relative to plug housing 96. Top shell front pivot 134 is held under bottom shell hold down 130 at front end and close over cable jacket at back end. In this position, straps 116 are extending outward towards left on bottom and right on top. Top shell feature pads 140 and 136 located at 80 degrees angle relative to collar central axis. Bottom shell also features pads 140 and 136 that are 180 degrees to respective pads on top shell. Collar features slots 138 and 142 matching pads 140 and 136 on top and bottom shells. To assemble collar 118, collar slots 156 are aligned with the straps 116; pads 136 and 140 are aligned with slots 138 and 142, collar is moved over pads 136 and 140. Once pads bottom out in axial slots, collar is turned clockwise to tighten straps 116 around cable to desired load. Collar teeth 146 engage with collar stop 114 to keep collar in turned position. Pads 136 and 140 are constrained in collar groove 148 and prevent collar 118 from coming off. To re-terminate plug, collar stop 114 is pressed away from teeth 146, collar is turned counter clockwise till it is returned to loading position and pulled back. Pad 140 and 136 relative position prevents collar from coming off at any other position during rotation except starting position or 360 degree turn position. This embodiment uses 80 degree angle between pads 136 and 140 and 180 degree angle between corresponding pad on other shell but, it can be any angle except whole number that multiple of pad angle between shells. Collar 118 inside opening is designed to fit over largest diameter cable having thicker insulation and 22 AWG conductors. Collar rotation allows straps to wrap around smaller diameter cables to have effective bonding with cable shield and adequate strain relief. IDCs are sized to allow effective termination for solid and stranded multiple gage conductors while allowing for multiple re-termination cycles.

While particular embodiments and applications of the present invention have been illustrated and described, it is to be understood that the invention is not limited to the precise construction and compositions disclosed herein and that various modifications, changes, and variations may be apparent from the foregoing without departing from the spirit and scope of the invention as described.

The invention claimed is:

1. A communication plug comprising:

a housing;

at least one strap connected to a rear of the housing;

a cylindrical collar, the collar defining a front face and a rear face, the collar having a channel extending from the front face to the rear face and at least one slot in a wall of the collar extending from the front face of the collar and further wherein the at least one slot is configured to engage the at least one strap prior to the collar being rotated relative to the housing wherein the collar further comprises a collar groove and at least one pad slot located on an inside wall of the collar, the collar groove extending in a radial direction and the at least one pad slot extending axially from the collar groove to the front face and further wherein the housing has at least one pad located on a rear of the housing, the at least one pad configured to engage the at least one pad slot and the collar groove by having the at least one pad engage the at least one pad slot when the at least one pad slot is aligned with the at least one pad and the collar is moved axially towards the housing and a then by having the pad slot engage the collar groove when the collar is adjacent to the housing and rotated relative to the housing.

2. The communication plug of claim 1 further comprising teeth located on the front face of the collar configured to engage a collar stop attached to the rear of the housing.

3. The communication plug of claim 2 wherein the collar stop and teeth are configured to allow the collar to rotate in a first direction relative to the housing but prevent the collar from rotating in a second direction, the first direction being opposite the second direction.

4. The communication plug of claim 3 wherein the straps are composed of a spring-like material.

5. The communication plug of claim 4 wherein the collar stop is composed of a spring-like material.

* * * * *